US010391354B2

(12) United States Patent
Barton et al.

(10) Patent No.: US 10,391,354 B2
(45) Date of Patent: Aug. 27, 2019

(54) HIGH PERFORMANCE ROPE EXERCISE HANDLE

(71) Applicant: Ready Made Gear LLC, Tamuning, GU (US)

(72) Inventors: Logan Barton, Tamuning, GU (US); Dennis Welle, Tamuning, GU (US)

(73) Assignee: READY MADE GEAR LLC, Tucson, AZ (US)

( * ) Notice: Subject to any disclaimer, the term of this patent is extended or adjusted under 35 U.S.C. 154(b) by 442 days.

(21) Appl. No.: 15/200,978

(22) Filed: Jul. 1, 2016

(65) Prior Publication Data

US 2017/0021224 A1 Jan. 26, 2017

Related U.S. Application Data

(60) Provisional application No. 62/187,290, filed on Jul. 1, 2015.

(51) Int. Cl.
*A63B 5/20* (2006.01)
*A63B 21/00* (2006.01)

(52) U.S. Cl.
CPC ..... *A63B 21/4035* (2015.10); *A63B 5/20* (2013.01)

(58) Field of Classification Search
CPC ..... A63B 5/20–2015; A63B 21/0043; A63B 21/4035; Y10T 16/44–516
See application file for complete search history.

(56) References Cited

U.S. PATENT DOCUMENTS 5,256,120 A * 10/1993 Howell ..... A63B 5/20 472/128
6,544,148 B1 * 4/2003 Loew ..... A63B 5/20 482/82
7,462,140 B1 * 12/2008 Lombardozzi ..... A63B 5/20 482/108
8,911,333 B2 12/2014 Hunt
9,381,391 B1 * 7/2016 Welty, II ..... A63B 5/20

* cited by examiner

*Primary Examiner* — Jennifer M Deichl
(74) *Attorney, Agent, or Firm* — Standley Law Group, LLP; Adam Smith

(57) ABSTRACT

The present invention is a high performance jump rope handle which comprises a bearing assembly and attachment device for either adjustable or static attachment of a rope for use in the activity of jumping rope for exercise or entertainment. The high performance handle may also comprise a magnetic means for attaching the handle to a ferrous material when not being used.

16 Claims, 10 Drawing Sheets

HIGH PERFORMANCE ROPE EXERCISE HANDLE

CROSS-REFERENCE TO RELATED APPLICATION

This application claims priority to provisional application 62/187,290 filed on Jul. 1, 2015 and is incorporated by reference in its entirety as if fully recited herein.

TECHNICAL FIELD

Exemplary embodiments of the present invention relate generally to a handle designed for use during exercise involving a jump rope system.

BACKGROUND

Jumping over a rope (or jump rope) is a form of exercise that is well known. Jump rope, as the activity (and rope itself) is often referred to in the United States, likely originated hundreds of years ago. Originally, the rope may have been a simple length of rope repurposed from its original use and converted to a toy. Over time, handles were added to the rope and the rope may have been weighted to improve the characteristics of its swinging action. In addition to a form of entertainment, jump rope has taken a more serious turn and become popular as a form of exercise. In particular, jump rope has become a facet of exercise programs that combine various exercises which function together to vary the area of the body exercised and the type of exercise performed (i.e. strength, agility, and cardiovascular improvement). Such a combination of exercise is referred to as cross training. An organized form of cross training that has become extremely popular is known as CrossFit (CrossFit, Inc. Washington D.C.). Because of this increase in popularity and the desire for those engaged in such engaged in such exercise programs to have high quality exercise equipment, there is a need for a high performance, durable and easily maintained jump rope system.

SUMMARY OF THE INVENTION

A summary of certain embodiments of the invention disclosed herein is included below. It should be understood that these aspects are presented for purposes of providing the reader with summary of these embodiments and that these aspects are not intended to limit the scope of this disclosure. Indeed, this disclosure may encompass a variety of aspects that may not be set forth below.

A jump rope is generally comprised of a rope, which may be fiber rope or a metal cable (for ease of discussion, each referred to interchangeably herein as a rope). In addition to the rope, a jump rope may also be comprised of a pair of handles. The rope may be terminated at each end with a loop or other method of attachment to the handle. In particular, embodiments of the disclosed invention are handles which are comprised of a grip portion, a bearing assembly, clamps that affix the bearing assembly to the grip portion, and in certain embodiments, an end cap positioned on the handle opposite of the bearing. In certain embodiments of the invention, the clamps may be adjustable to permit a user to remove the bearing assembly for maintenance or replacement. In other embodiments, the bearing may be permanently or semi-permanently affixed to the grip portion. In addition to a bearing, the bearing assembly may also comprise a shaft assembly that passes through the bearing. The shaft assembly may comprise an attachment provision for attachment of the rope portion of a jump rope.

In certain embodiments of the invention, an end termination may be positioned at the opposite end of the grip portion from the bearing assembly. This end termination may be attached to the grip portion with a clamp in a manner similar to how the bearing assembly is attached.

In certain embodiments of the invention, a magnet may be incorporated into or otherwise affixed to the end cap such that the handle assembly may be attached to a metal structure for storage when not in use. In certain of these embodiments, such a magnet may be otherwise incorporated into the handle by molding the magnet into the grip portion of the handle. In other such embodiments, the magnet may be affixed to a carrier that is flexibly attached to the end cap portion of the handle assembly.

In embodiments of the invention, weighting mechanisms may be inserted into the handle assembly and held in place by the action of a clamp or a clamp and end cap to increase the effort required of the user to perform the jump rope exercise.

In certain embodiments of the invention, the rope may be secured in a manner that its length is adjustable without the need for tools. In addition to these adjustments, certain embodiments of the invention may be equipped with stylized features that allow a manufacturer or user of the invention to customize the appearance of the jump rope handle.

Again, the brief summary presented above is intended only to familiarize the reader with certain aspects and contexts of embodiments of the present disclosure without limitation to the claimed subject matter.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Figure 1A:
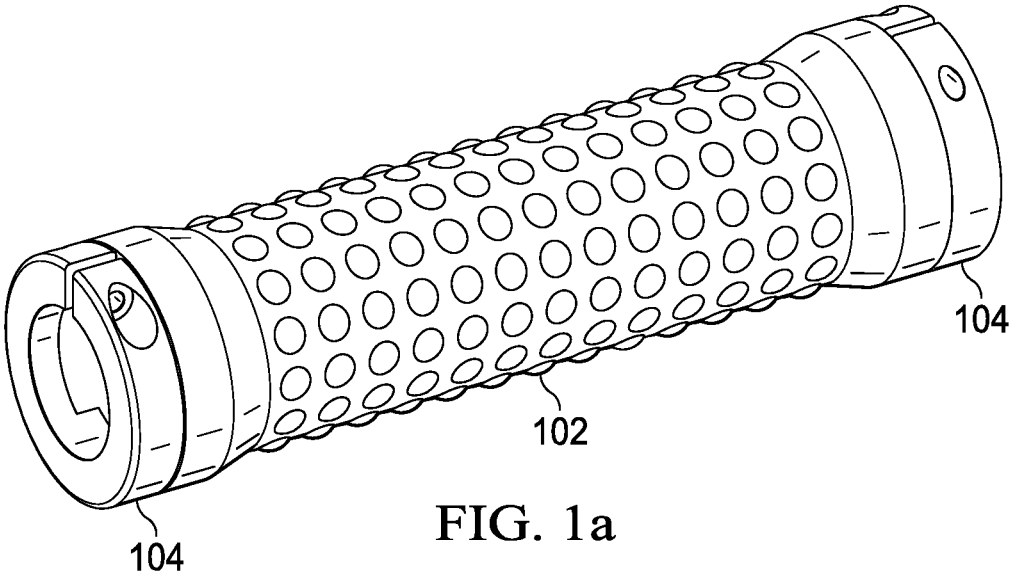
FIG. 1*a* is an illustration of a grip portion of an embodiment of the invention with a clamp assembly at each end of the grip portion.
Figure 1B:
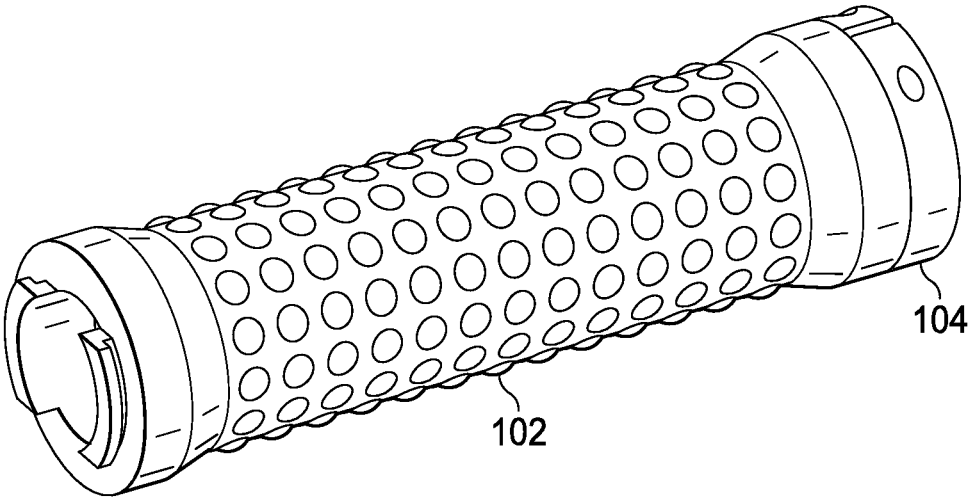
FIG. 1*b* is an illustration of the grip portion of an embodiment of the invention with a claim assembly at one end of the grip portion.
Figure 1C:
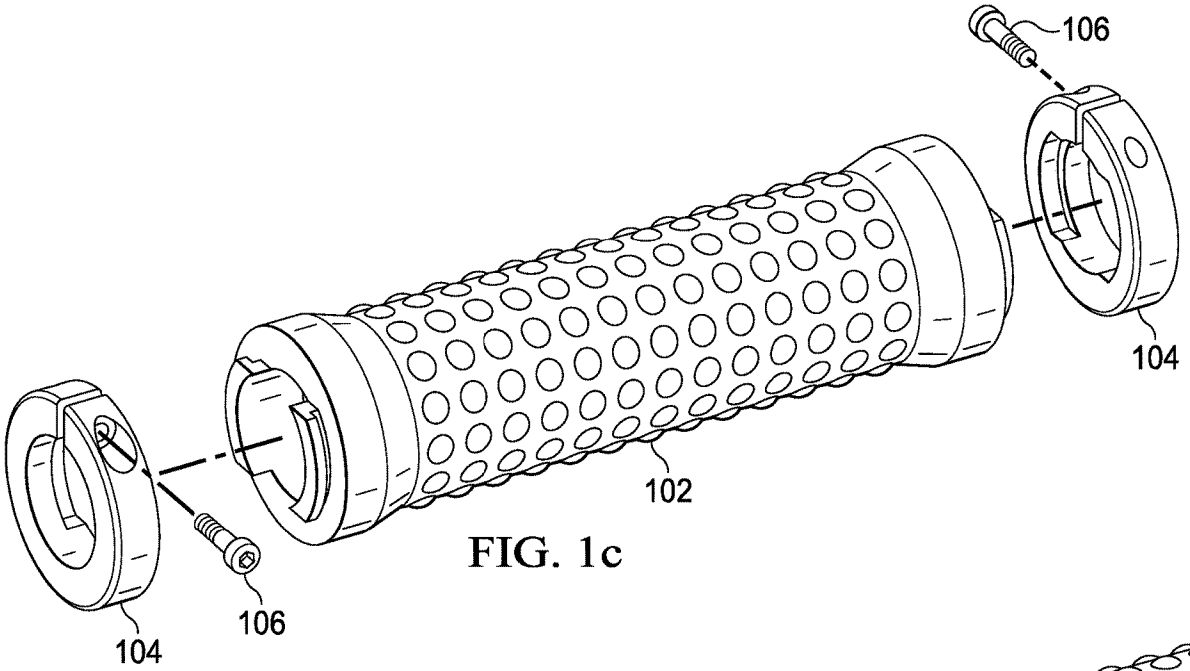
FIG. 1*c* is an illustration of the grip portion of an embodiment of the invention showing the claim portions partially disassembled.

As is illustrated in FIGS. 1*a* and 1*b*, an embodiment of the invention may comprise a grip section 102 to which at least one clamp 104 may be affixed. As is illustrated in FIG. 1*b*, embodiments of the invention may be equipped with a single clamp 104, leaving the opposite end of the grip without a claim. As is illustrated in FIG. 1*c*, clamps may be removably secured by hardware such as, but not limited to screws 106.

Figure 2A:
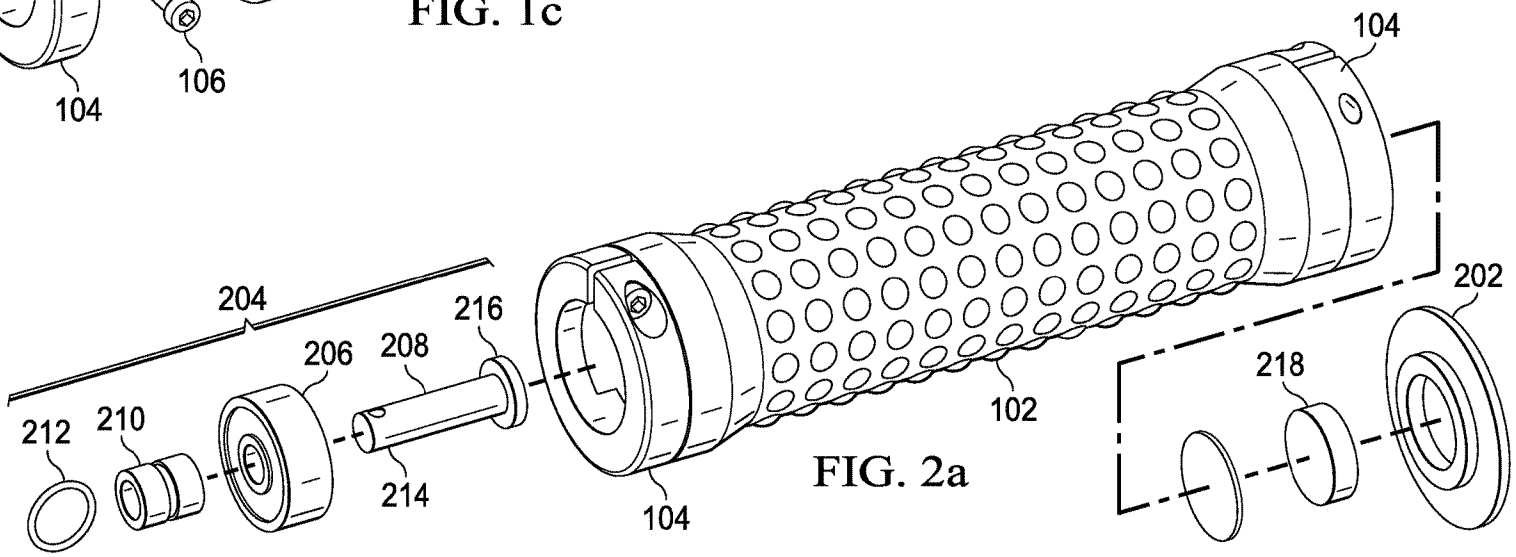
FIGS. 2*a*-2*e* illustrate an embodiment of the invention in an exploded view as various portions of the embodiment are partially assembled.

FIGS. 2*a*-2*e* illustrate an embodiment of the invention in various stages of assembly. As is shown in FIG. 2*a*, an embodiment of the invention may comprise a grip section 102, at least one clamp 104, an end cap 202, and a bearing assembly (shown assembled in FIG. 2*c* as 204). As is illustrated in FIG. 2*a*, the bearing assembly 204 may be comprised of at least one bearing 206, a shaft 208, a spacer subassembly 210, and an attachment device 212. As is illustrated, the embodiment shows an attachment device 212 formed using a split ring. In the illustrated embodiment, the attachment device serves two functions; the first is to secure the shaft 208 and spacer 210 to the bearing 206. As is illustrated in the embodiment, the shaft may comprise a hole formed in the shaft 214. Also, the shaft may comprise a means for preventing it from passing completely through the bearing 216. The illustrated means is a collar shape 216 but may be, without limitation, an enlarged portion of the shaft, a fastener, or a second hole and split ring. The second function of the attachment device 212 may be to attach a rope as illustrated in FIGS. 3*a* and 3*b* at 302. Referring again to FIG. 2*a*, the bearing 206 of the bearing assembly 204 may be formed from a sealed or semi-sealed bearing assembly. Examples, without limitation, of such bearings 206 may include ball bearings, roller bearings, or bearings employing plastic materials such as ultra high molecular weight (UHMW) polyethylene bearing surfaces. Roller or ball bearings may be formed using metal or ceramic materials. In addition, in embodiments of the invention, bearing assemblies 204 may comprise more than one bearing 206. In such an embodiment, a plurality of bearings may be positioned on the shaft 214. To accommodate these bearings, the shaft 214 may be extended, the spacer 210 may be reduced in length, or a combination of the two may be used.

Figure 2B:
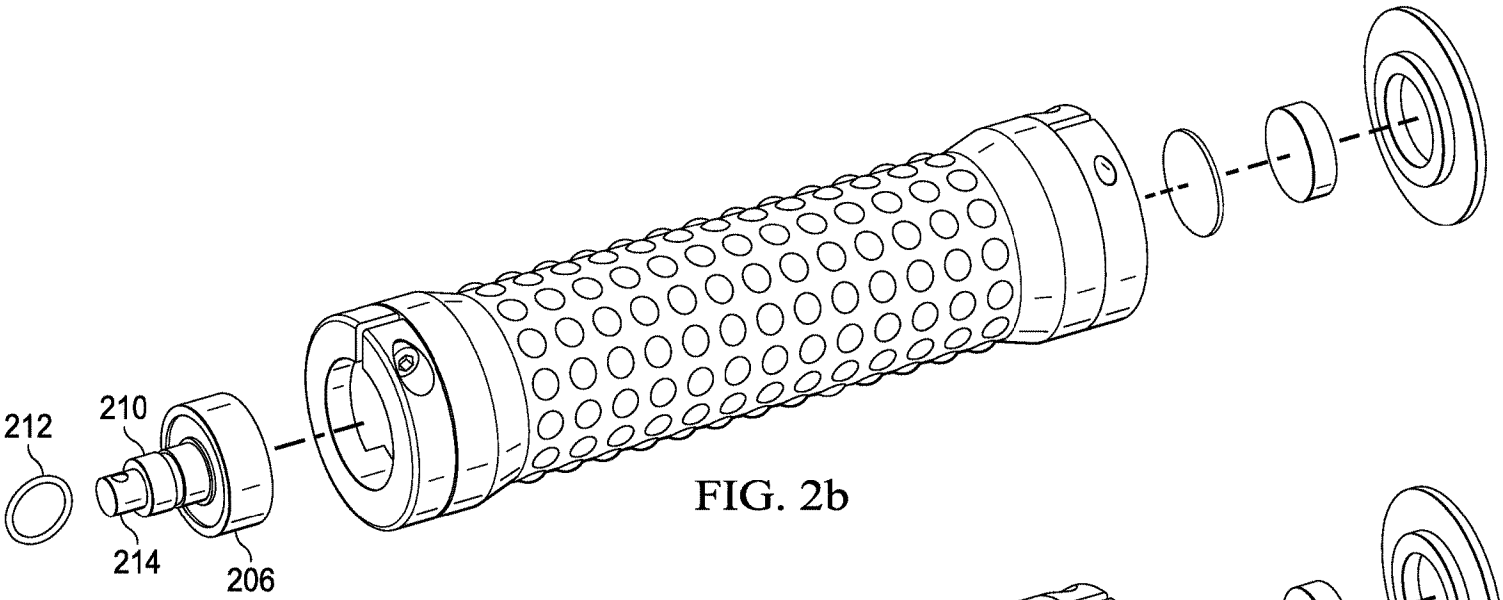
Figure 2C:
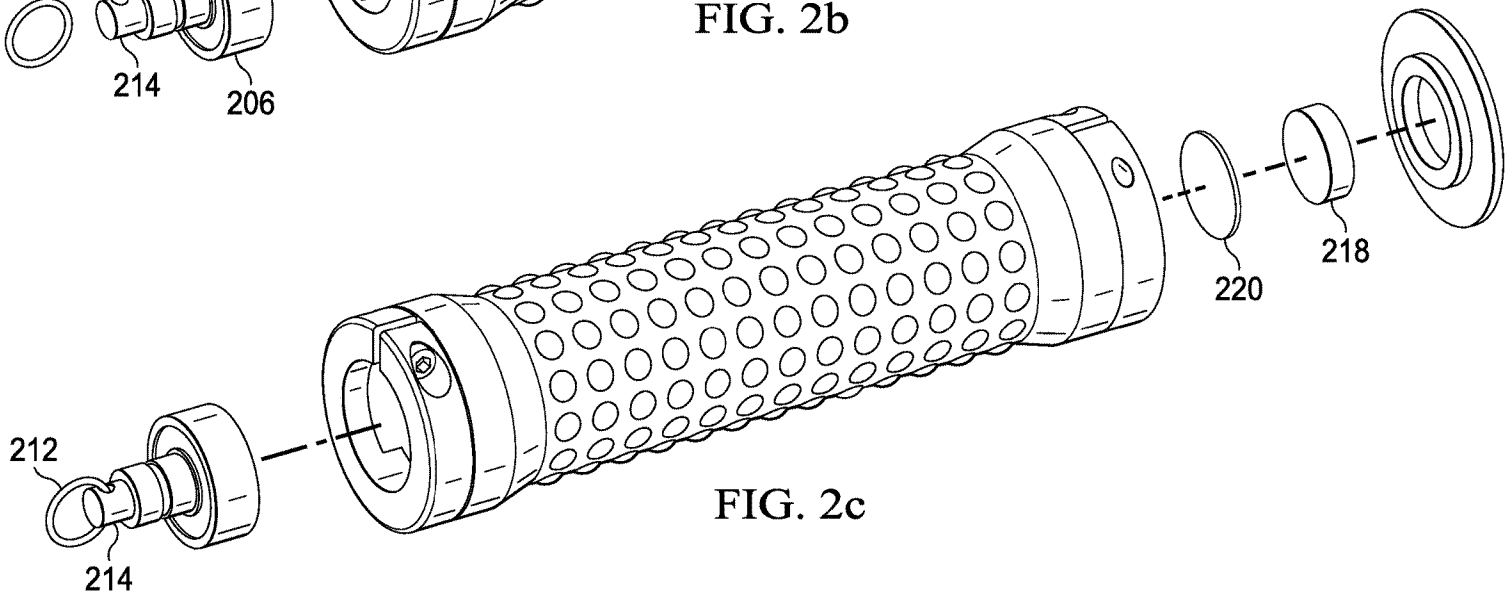
Figure 2D:
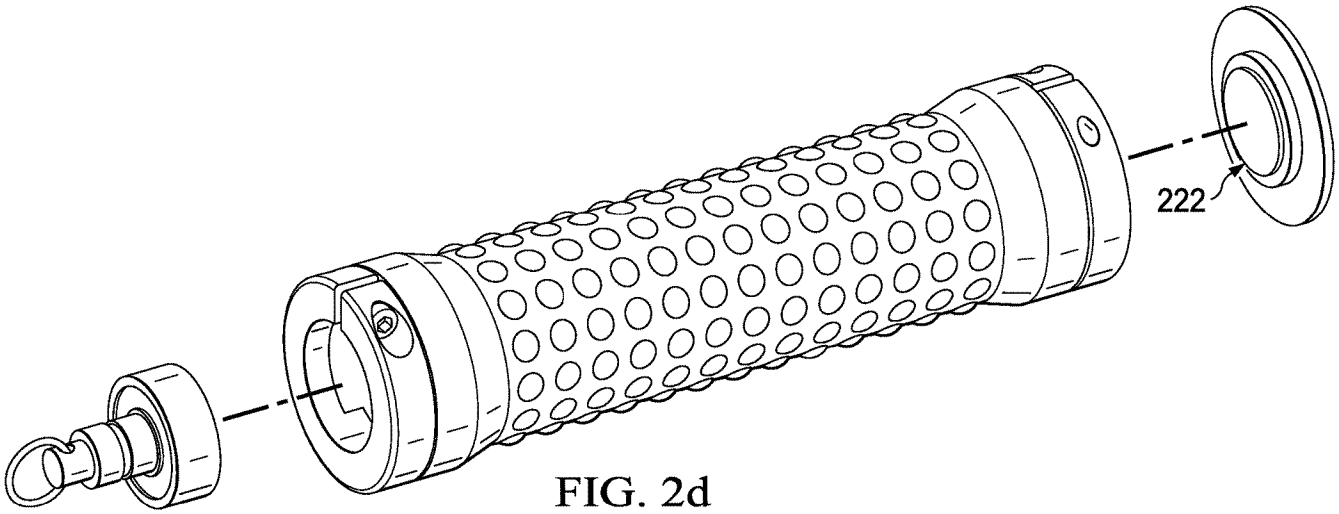
Figure 2E:
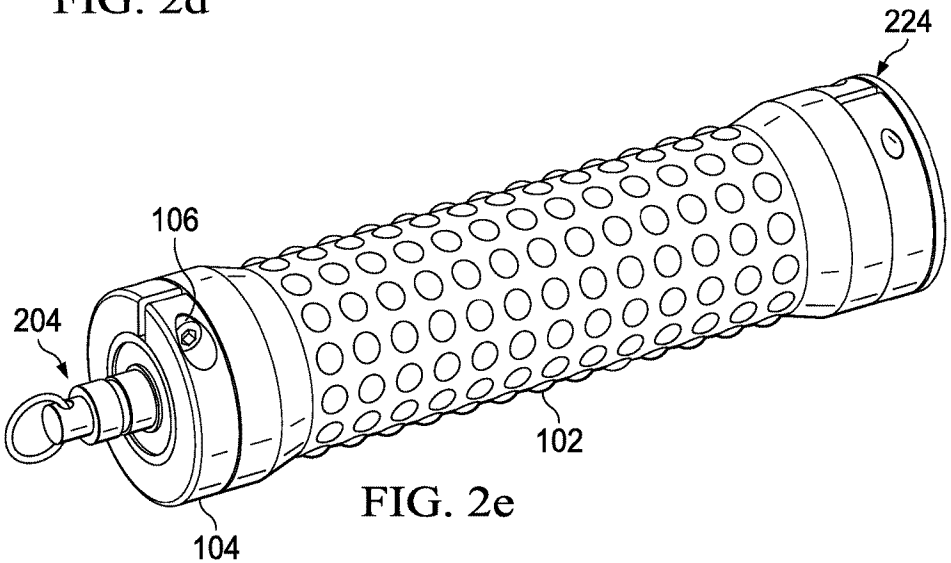
Figure 3A:
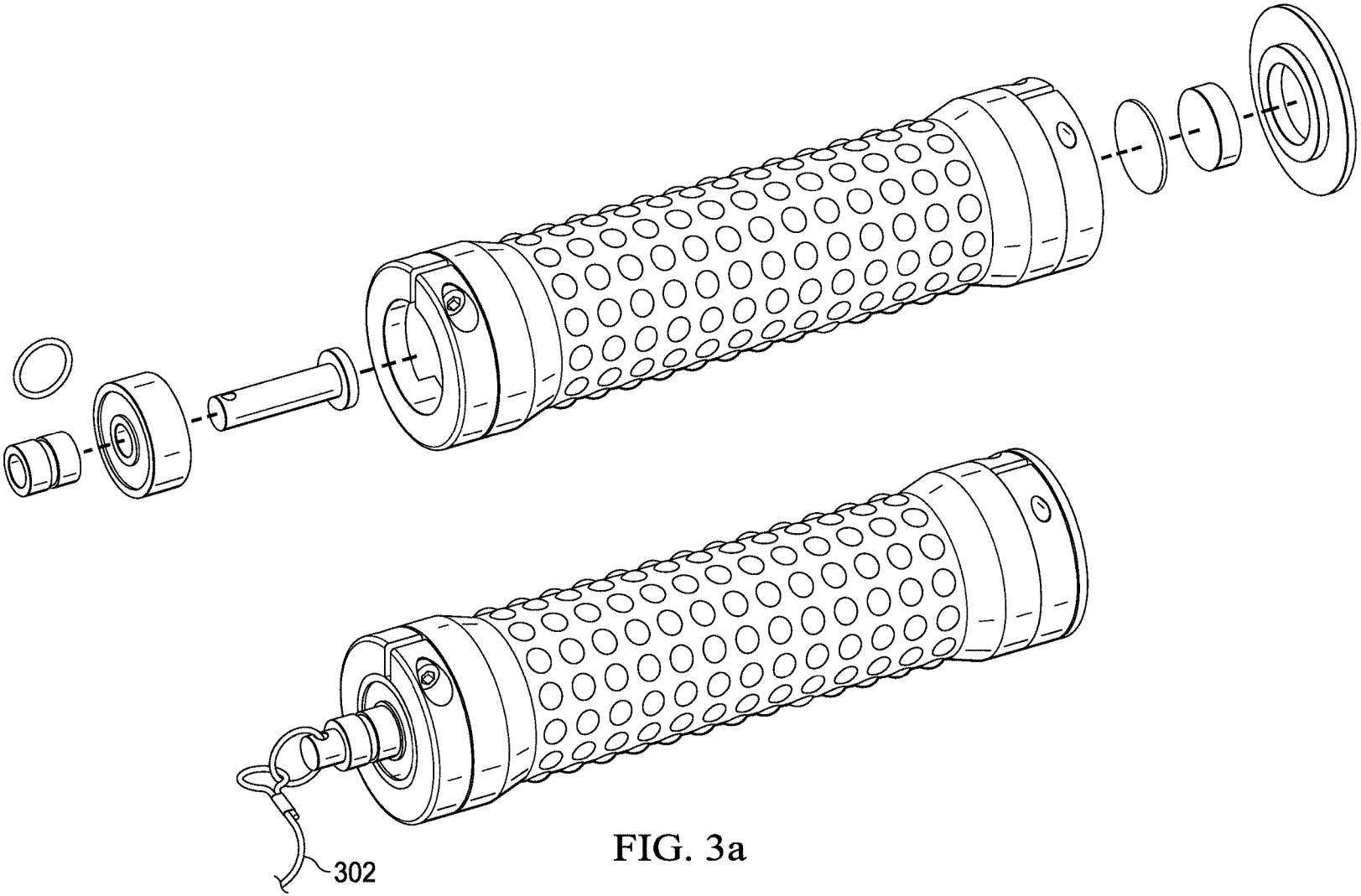
FIG. 3*a* is a view of an embodiment of the invention illustrating an exploded view as well as an assembled view connected to a rope.
Figure 3B:
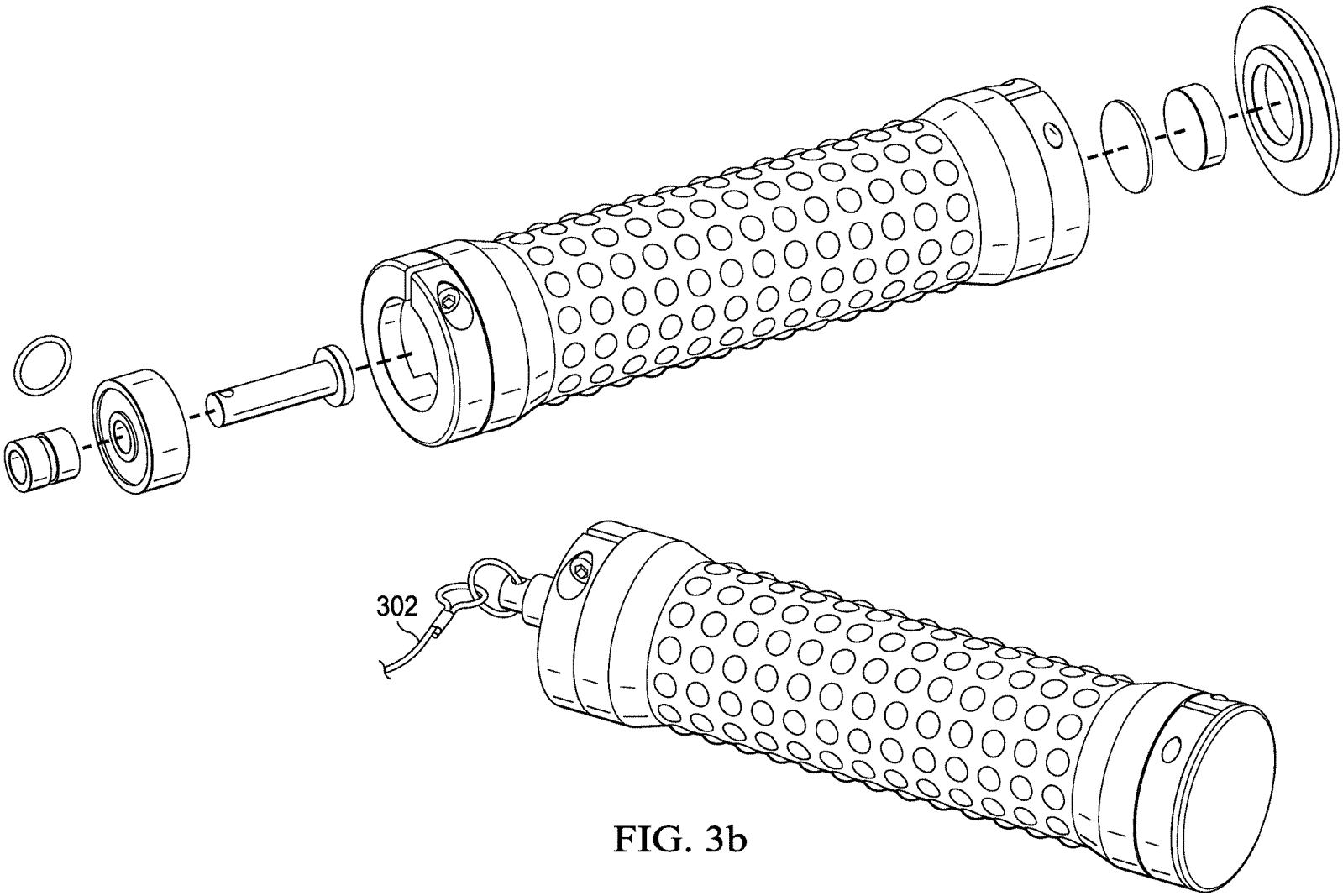
FIG. 3*b* is an alternate view of an embodiment of the invention illustrating an exploded view as well as an assembled view connected to a rope.

As is illustrated in FIG. 2*b*, the shaft 214 may be placed in an opening formed in the center of the bearing 206 and a spacer 210 placed upon the shaft. As is illustrated in FIG. 2*c*, an attachment device 212 may then be placed through a hole formed in the shaft 214. As is illustrated in FIG. 2*e*, the bearing assembly 204 may be positioned in an end of the grip section 102. As is shown, a clamp 104 may be positioned on the grip section 102 and secured using a screw 106.

Figure 4C:
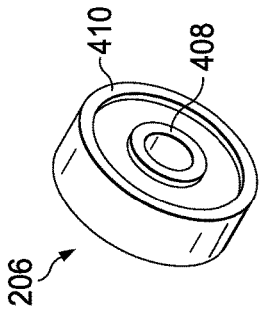
FIG. 4*c* is a view of a bearing used in an embodiment of the invention.
Figure 4B:
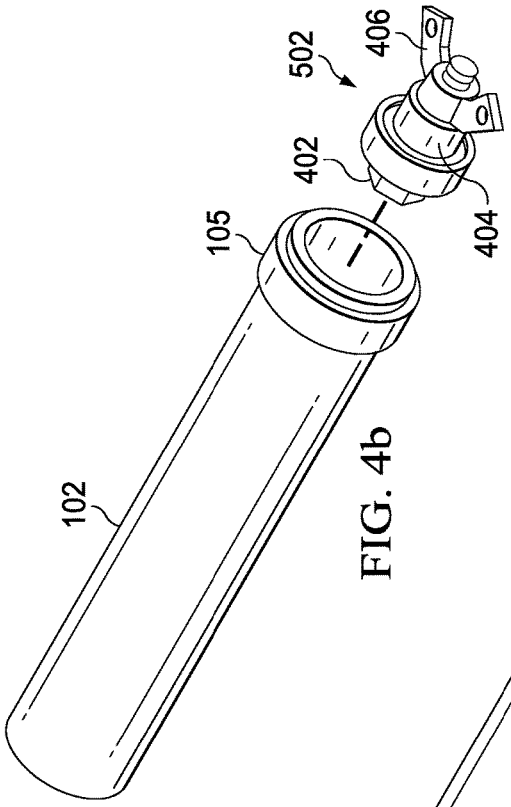
FIG. 4*b* is a view of the partially assembled components of an embodiment of the invention.
Figure 4A:
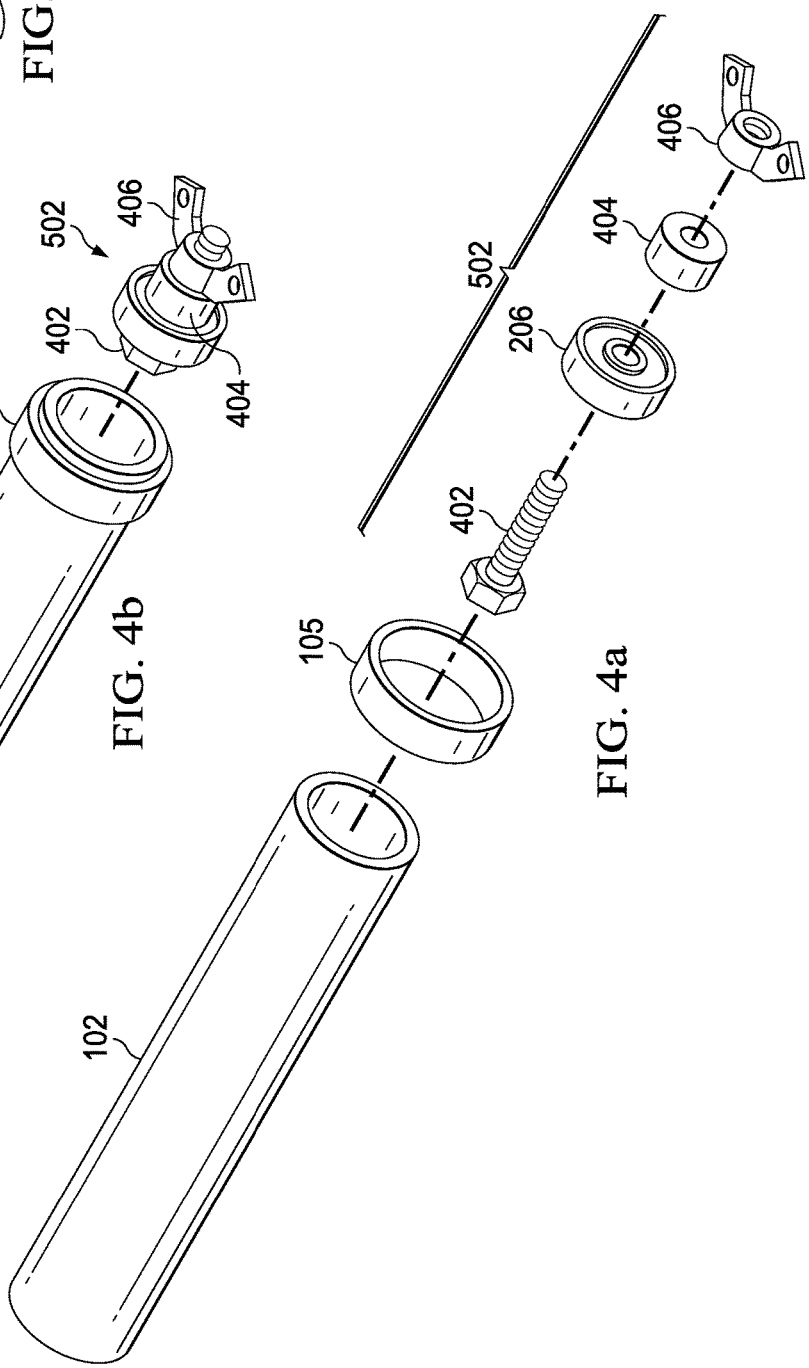
FIG. 4*a* is a view of the unassembled components of an embodiment of the invention.

Other methods of securing the clamp may be used. One such method is illustrated in FIGS. 4*a* and 4*b*. In such an embodiment, a clamp 105 may be configured such that it is compressively affixed to the grip section 102. As illustrated, such a clamp 105 may be formed in a manner that does not embody a screw to affix the clamp to the grip section 102. As is illustrated in FIG. 5, once a bearing assembly 502 is inserted into the grip section 102, the clamp 105 may be compressed from its outer surface (crimped) such that it is caused to become affixed to the grip section 102, causing the grip section to be pressed tightly against the outer surface of the bearing assembly 502, securing the bearing assembly to the grip section 102.

Figure 6A:
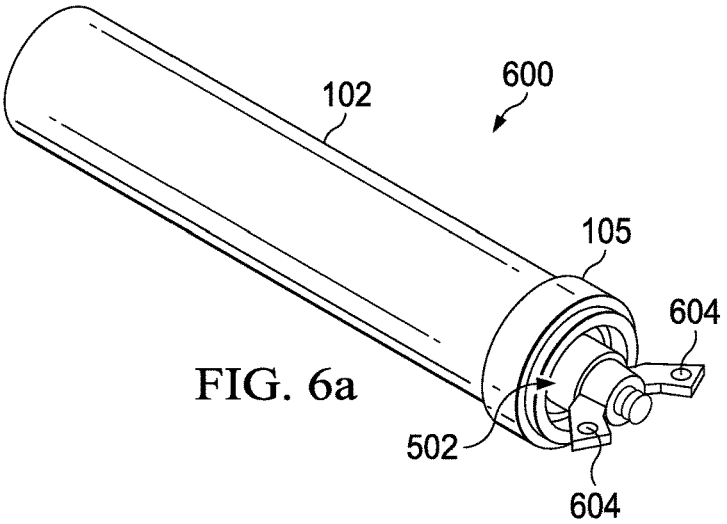
FIGS. 6*a* and 6*b* are views of an embodiment of the invention illustrating a handle and the handle with a rope attached.

Referring again to FIG. 4*a*, in another embodiment of the invention, the bearing assembly 502 may comprise a bearing 206, a shaft 402 that is at least partially threaded, a spacer 404, and an attachment device 406. As illustrated in FIG. 4*b*, the various components of the bearing assembly are assembled and the attachment device 406 positioned on the shaft 402. In the illustrated embodiment, the attachment device 406 threads onto the threaded portion of the shaft. In certain embodiments, the spacer 404 may be formed of a compressible material such that when assembled, the spacer exerts pressure against the attachment device 406, preventing the attachment device from becoming unthreaded from the shaft 402. Referring to FIG. 4*c*, in such an embodiment, the shaft may compressibly contact an inner race portion 408 of the bearing 206, facilitating the free movement of the shaft with regard to the outer race portion 410 of the bearing. This arrangement permits the shaft/spacer/attachment device to rotate independently of the outer race 410 and thus the grip section 102 of the handle. FIG. 6*a* illustrates a completed handle assembly 600 according to an embodiment of the invention. As is shown, the grip section 102 is secured to the bearing assembly 502 by a clamp 105. In the embodiment illustrated, the clamp 105 has been compressed in order to affix the bearing assembly to the grip section 102 such that when in use, the bearing remains securely within the grip section.

Figure 6B:
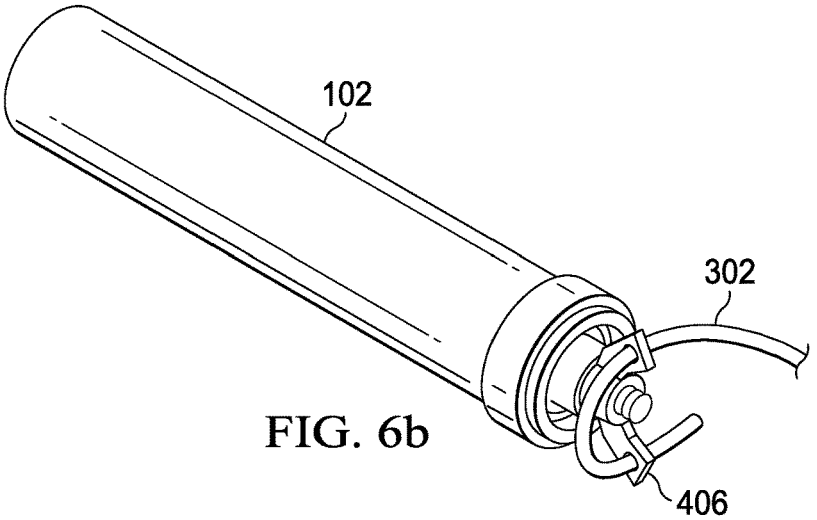

As is illustrated in FIG. 6*b*, a rope 302 may be inserted into openings 604 in the attachment device 406. In such a configuration, friction between the rope 302 and the attachment device 406 may be sufficient to hold the rope in place while the handle and rope is used to perform a jump rope exercise. In such an embodiment, the length of the rope may be easily adjusted to accommodate the physical characteristics of a user. For instance, a user who is shorter in stature may wish a rope that is shorter in length than would a taller person. In such a circumstance, the user may adjust the position of the rope by moving it through the openings in the attachment device.

Figure 5:
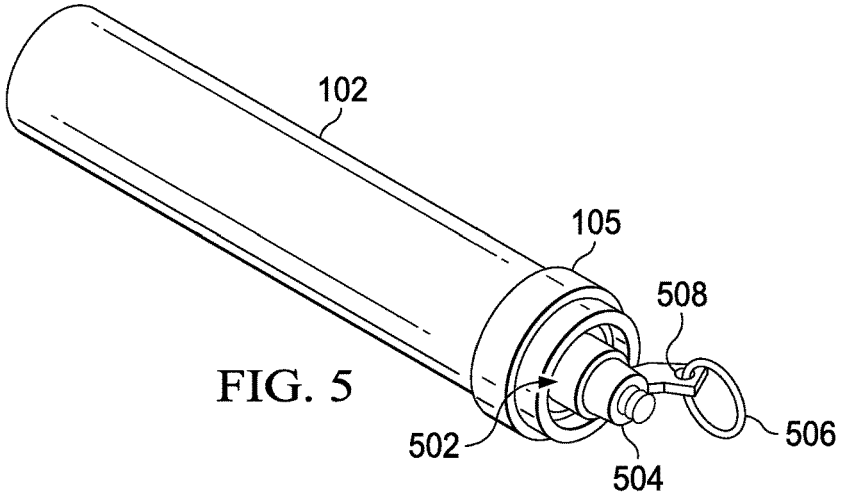
FIG. 5 is a view of an assembled embodiment of the invention.

In a similar embodiment, an attachment device 504 may be configured to accept a split ring 506 as illustrated in FIG. 5. In such an embodiment, the split ring may be used to attach the rope in a manner similar to FIG. 3*a*. In such an embodiment, the attachment device may have a single hole 508 as in FIG. 5, or may have multiple holes 604 as illustrated in FIG. 6*a*.

As illustrated in FIGS. 5 and 6*b*, the rope 302 may be attached to an attachment device 504 such that the attachment point is offset from the central axis of the shaft 402. As a result, the user of the jump rope handle may be exposed to a lesser amount of rope feedback through a handle in the user's hands.

Figure 7:
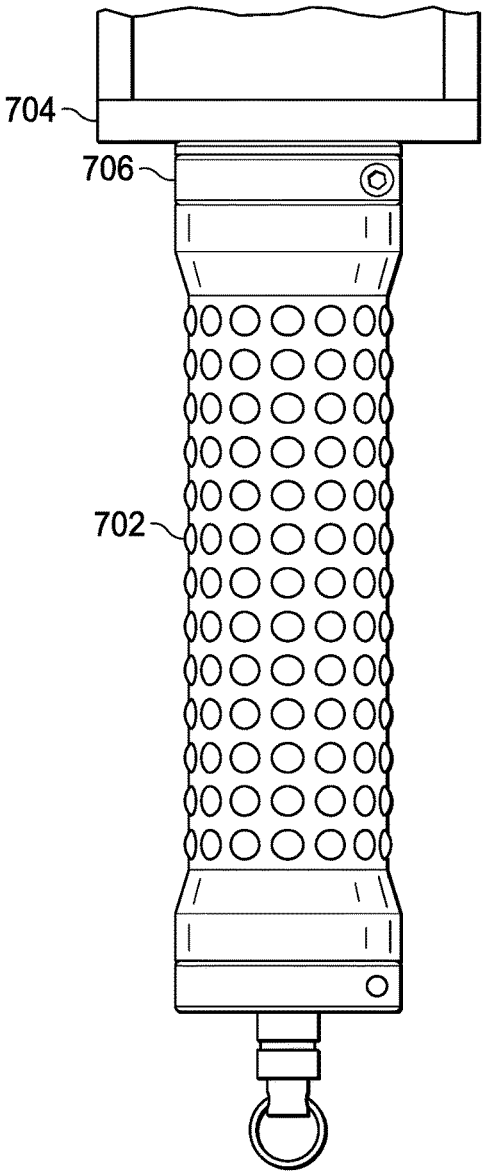
FIG. 7 is an illustration of an embodiment of the invention with a magnetic end portion hanging from a metallic structure.
Figure 8:
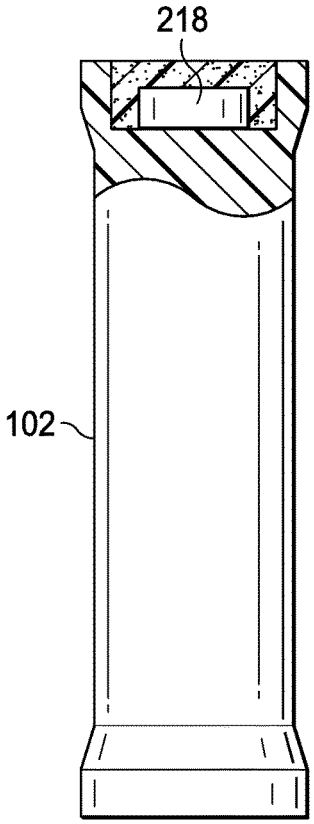
FIG. 8 is an illustration of an embodiment wherein a magnetic is encapsulated into a handle assembly by molding.
Figure 9:
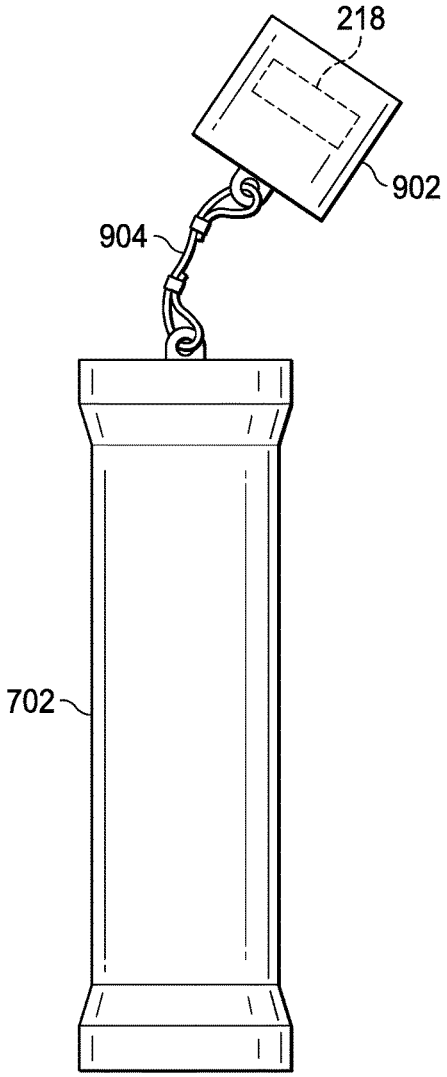
FIG. 9 is an illustration of an embodiment of the invention illustrating a magnet enclosed in a carrier flexibly attached to an end of the handle assembly.

In certain embodiments of the invention, a means may be provided to secure the jump rope handles when the jump rope is not being used. Such a means will allow a user to quickly and easily store the jump rope when the user is performing other exercise activities. An example of such storage is illustrated in FIG. 7. As is shown, the handle 702 is suspended from a ferrous surface 704 using a magnet found in an end portion 706 of the handle. Referring again to FIG. 2*a*, a high strength magnet 218 may be provided as part of the end portion 202 of a handle assembly. As is illustrated in FIG. 2*c*, a means 220 such as an adhesive tape or glue may be provided to secure the magnet 218 to the end portion 202. As is shown in FIG. 2*d* at 222, the magnet may be secured to the end portion 202 using an adhesive tape material 220. Once secure, the end portion may be attached to the grip section 102 as is illustrated at 224 in FIG. 2*e*. In other embodiments of the invention, such a magnet 218 may be molded into an end portion 706 or as illustrated in FIG. 8, may be molded into a grip section 102 of the handle 702. Alternatively, the magnet 218 may be affixed within the grip section 102 using a resin material. Other embodiments may attach the magnet to the end cap using a flexible tether such that the magnet is located externally to the handle. An example of such an embodiment is illustrated in FIG. 9. As is shown, a magnet 218 may be enclosed by or otherwise affixed to a pendant 902. The pendant 902 may be secured to a handle 702 using a flexible tether 904. Such an embodiment may provide additional security against a handle being unintentionally detached from the ferrous surface to which it was originally attached.

Figure 10:
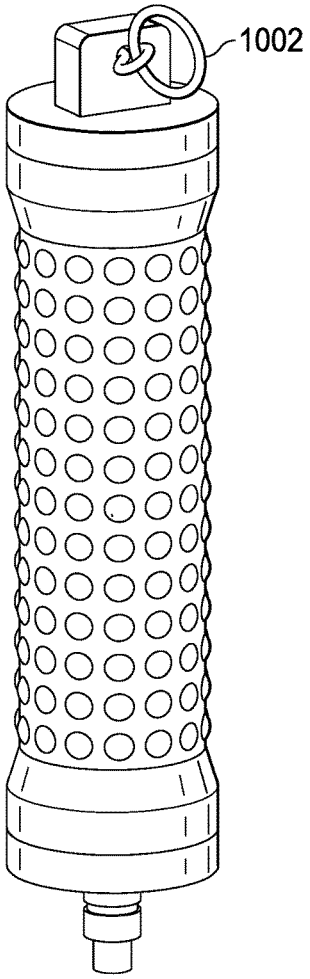
FIG. 10 is an illustration of an embodiment of the invention showing a decorative end portion.

In addition to the end portion 202 illustrated in FIG. 2*a*, other embodiments of the invention may utilize an end portion with decorative elements applied or molded into the end portion. Examples may include logos and other graphic images. In certain embodiments, the end portions may be formed to simulate items that are of interest to a user or to conform to a stylistic theme followed by other products offered by a seller of the jump rope handles. An example of such an embodiment is illustrated in FIG. 10 where an end portion simulates a safety pin pull ring 1002 of a hand grenade.

In certain embodiments of the invention, items may be inserted into the jump rope handle to add weight to the handle. Such embodiments may assist a user in achieving a higher level of fitness as the result of having to resist the action of the increased weight of the jump rope handles.

An advantage of the disclosed embodiments of the invention is the interchangeability of the various components of the jump rope handle and rope. When using an embodiment of the invention, a user may change the bearings, handles, any weights, the rope, or end portions to suit that user's individual tastes or exercise goals. Depending upon the configuration of the user's jump rope handle, changing of one or more of the components may be performed with minimal tools.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A handle for a jump rope comprising:

a hand grip portion;

at least one bearing assembly located proximate to a first end of the hand grip portion;

an affixing collar for securing the at least one bearing assembly to the hand grip portion;

a shaft passing through the at least one bearing assembly;

a means for affixing a first end of a rope to the shaft; and a magnet located proximate to a second end of the hand grip, wherein said magnet is configured to permit the handle to be temporarily secured to a metal structure by magnetic forces exerted by the magnet for storage.

2. The handle of claim 1, wherein the collar for securing the at least one bearing assembly is a clamping collar which is deformed by at least one screw to clamp to the hand grip portion.

3. The handle of claim 1, wherein the collar for securing the at least one bearing assembly is a compression ring that is compressed externally to cause the ring to deform to be secured to the hand grip portion.

4. The handle of claim 1, wherein the shaft passing through the bearing assembly comprises a threaded portion and the means for affixing a first end of the rope is a threaded fastener secured to the shaft by threads that mate with the threaded portion of the shaft.

5. The handle of claim 4, where the threaded fastener comprises a portion offset from the shaft and the offset portion further comprises an opening formed to allow the rope to be attached to the fastener.

6. The handle of claim 4, where the threaded fastener comprises a first portion offset from the shaft and a second portion offset from the shaft and opposite the first portion, the first and second portions each comprising an opening through which the rope is passed, said openings configured to frictionally engage the rope to secure it in place.

7. The handle of claim 1, wherein the means for affixing the first end of the rope is selected from one of: a snap ring, a split ring, an O-ring, and a D-ring.

8. The handle of claim 1, where the shaft is configured such that a first end of the shaft is enlarged such that the enlarged portion will not pass through the bearing assembly and the second end of the shaft is configured with an opening through which the means for affixing the rope is inserted.

9. The handle of claim 1, where the magnet is secured to the hand grip portion using an adhesive material.

10. The handle of claim 1, where the magnet is secured to the hand grip portion by being enclosed by material from which the hand grip portion is formed.

11. The handle of claim 1, where the magnet is secured in a pendant which secured to the hand grip portion by a flexible cord.

12. A jump rope system comprising:

a rope;

a plurality of handles, each handle comprising:

a hand grip portion;

at least one bearing assembly located proximate to a first end of the hand grip portion and configured to permit rotation of the rope;

a means for affixing an end of the rope to the bearing assembly; and a magnet located proximate to a second end of the hand grip, wherein said magnet is shaped, configured, and oriented to permit the handle to be temporarily secured to a metal structure by magnetic forces exerted by the magnet for storage;

wherein the first end of each of the hand grip portions is located proximate to the end of the hand grip portion which receives the rope.

13. The system of claim 12, further comprising a shaft passing through the bearing assembly, wherein the rope is affixed to the bearing assembly by way of the shaft.

14. The system of claim 12, wherein each of the handles are substantially cylindrical in shape.

15. The system of claim 14, wherein each of the magnets are shaped as a thin disk and are oriented such that an upper and lower surface of the disk extends substantially parallel with a base of the respective handle.

16. The system of claim 15, wherein each of handles further comprises an end cap located on the second end of the respective hand grip portion, wherein each of the magnets are molded into the respective end cap.

* * * * *